US005593008A

United States Patent [19]

Magnusson

[11] Patent Number: 5,593,008

[45] Date of Patent: Jan. 14, 1997

[54] DUAL PURPOSE CASE

[76] Inventor: Thorsten Magnusson, Terrängvägen 2, Lidingö , Sweden, 181 30

[21] Appl. No.: 454,247

[22] PCT Filed: Dec. 14, 1992

[86] PCT No.: PCT/SE92/00865

§ 371 Date: Jun. 13, 1995

§ 102(e) Date: Jun. 13, 1995

[87] PCT Pub. No.: WO94/13169

PCT Pub. Date: Jun. 23, 1994

[51] Int. Cl.[6] ..... A45C 3/02; A45C 9/00; A45C 13/00

[52] U.S. Cl. ..... 190/8; 190/111; 190/112; 297/188.1

[58] Field of Search ..... 190/8, 109, 112, 190/114, 115, 111, 110, 125; 220/504, 531, 558; 297/188.01, 188.05, 188.09, 185.1

[56] References Cited

U.S. PATENT DOCUMENTS

| | | | |
|---|---|---|---|
| 469,107 | 2/1892 | Weatherly | 297/188.09 X |
| 896,529 | 8/1908 | Gray | 190/111 X |
| 4,210,363 | 7/1980 | Taipalus | 190/8 X |

FOREIGN PATENT DOCUMENTS

| | | | |
|---|---|---|---|
| 0422759 | 4/1991 | European Pat. Off. . | |
| 1519867 | 4/1968 | France . | |
| 468923 | 4/1993 | Sweden . | |
| 1461997 | 1/1977 | United Kingdom | 190/8 |
| 2258646 | 2/1993 | United Kingdom . | |

*Primary Examiner*—Allan N. Shoap
*Assistant Examiner*—Niki M. Kopsidas
*Attorney, Agent, or Firm*—Jacobson, Price, Holman & Stern, PLLC

[57] ABSTRACT

A dual purpose case fulfilling the function of a case, which also can be a temporary seat. This has been achieved by making the longest side of the base considerably shorter than the height of the case. Thus, it is possible to sit on the case, when it is standing on its base, without bending the knees in an uncomfortable way. The lid of the case has been formed so that sitting on it will be reasonably comfortable. The construction of the handle on the lid facilitates the change-over from conveying to sitting without special arrangements; only placing the case on a flat surface. When the case is carried with its longest dimension perpendicular, it will be a very small obstacle in crowded situations, as compared to current cases.

2 Claims, 1 Drawing Sheet

DUAL PURPOSE CASE

SUMMARY OF THE INVENTION

The dual purpose case of the present invention has three variations: "Attache", "Cabin", and "Racket". The case provides, besides its carrying function, a temporary seat as soon as it is put on the ground/floor. It is an alternative to current document-, cabin- and attache cases. Furthermore, many professional people will find it advantageous to have their hand tools/-instruments in a case, that also can be a temporary seat (e.g., doctors, nurses, electricians and plumbers).

The techniques needed for making the case of the present invention are the same as for making other luggage. A construction using fibre-plastic is preferable considering the support requirements of the construction.

DETAILED DESCRIPTION OF THE INVENTION

Figure 1:
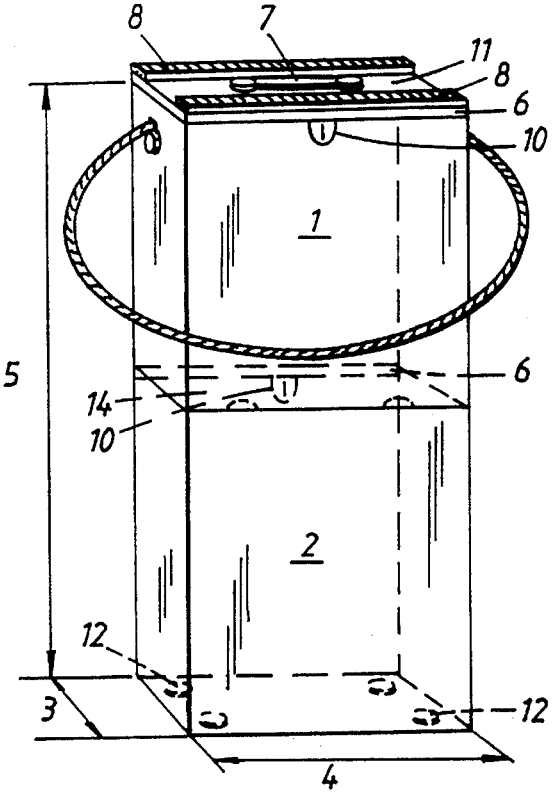
FIG. 1 is a front perspective view of the present invention.

The case is so constructed, that its base as shown in FIG. 1, is no bigger than is necessary to make room for A4 paper size binders in an upright position. A preferable base side represented by reference numerals 3 and 4 appears to be 30×12±2 cm. The height 5 is chosen so that the owner is able to sit on the case without bending his/her knees unnecessarily. A preferable height is in the range from 60 to 75 cm except in the case of the "cabin" version, since hand luggage in airplanes may not be higher than 45 cm. This means that this embodiment of the case will be less comfortable to sit on, but it will however be quite usable.

Figure 2:
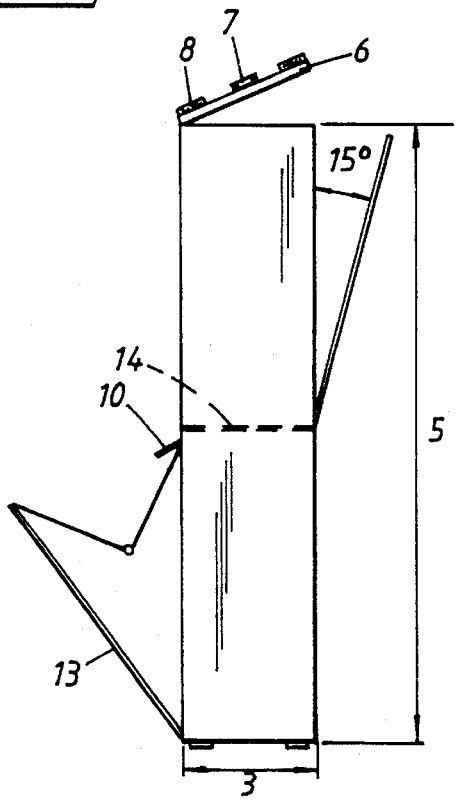
FIG. 2 is a side view of the present invention.
Figure 3:
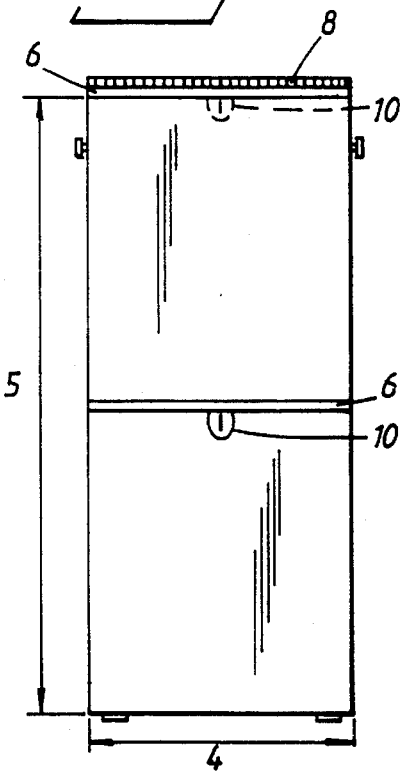
FIG. 3 is a rear view of the present invention.

The case is divided into two boxes, the upper box 1 is aimed for use with documents, the lower box 2 is used for business equipment or stop-over outfits. The "cabin" version is specially designed. The lid 11 of the upper box 1 is located at the top of the case with a regular brief-case lock 10 and a brim 6. It has upholstered strips 8 to sit on with the handle 7 located between strips 8. This construction makes it easy to load documents and binders in and out, when the case is upright. In order to facilitate skimming the documents, etc., it is possible to fold out the front of the upper box 1 by 15° (FIG. 2). The lid 13 of the lower box will then be located on the back of the case. It will be equipped with a regular brief-case lock and a brim. Supports 12 are located on the bottom of the case.

The floor 14 of the upper box 1 has hinges in the "racket" version, so the floor 14 can be folded up. The floor 14 may be the most common paper sheet size of the country in which the box may be used to transport tennis-, badminton- or squash-rackets.

The case has in comparison with existing brief-cases, etc., no obvious drawbacks but the following advantages. The owner can, with tolerable convenience, sit on the case in the tube-carriage at peak times, when waiting for luggage at an airport, or waiting for kick off in the standing-room of a sports ground (football, ice hockey, etc.) and in the example of special trades, which have irregular places of work. In an escalator, the case can be placed on the same step as the owner. The contents of the case can be easily loaded and unloaded, when the case is placed on the floor/ground. It is not necessary to put the case on the table or on ones knee.

When it is very crowded in elevators, stairs, swing doors, train-corridors, etc., the case will need a minimum of space because its base is very small and its profile almost similar to its owners.

The case can comfortably be carried long distances and up or down stairs because it has as an extra feature of a shoulderstrap and on the upper part of the sides, rotating loops for the snap-hooks of the shoulderstrap.

I claim:

1. A case which can be used for transport as well as a temporary seat, said case comprising a longest side of a base of the case being more than twice as long as a shortest side of the base, a height of the case being 1.5–2.5 times greater than the longest side of the base, the case being divided into a lower box and an upper box separated by a floor/ceiling, said upper being dimensioned to contain standing binders, a lid of the upper box having spaced upholstered strips for sitting and a handle located between the upholstered strips so as to not affect the sitting function, walls of the case having a solid structure to counteract pressure generated when the case is used for a sitting function, and the lid of the upper box having a brim.

2. A case according to claim 1, wherein the floor/ceiling located between said upper and lower boxes has hinges so the floor/ceiling is pivotable to a position which permits long objects to extend from the lower box into the upper box and rotating loops are located on upper edges to hold a shoulderstrap.

* * * * *